US006049937A

United States Patent [19]

Jacobs

[11] Patent Number: 6,049,937

[45] Date of Patent: Apr. 18, 2000

[54] WIRE RETENTION MECHANISM FOR A BROOM

[75] Inventor: Neal Jacobs, Wooster, Ohio

[73] Assignee: Rubbermaid Incorporated, Wooster, Ohio

[21] Appl. No.: 09/048,352

[22] Filed: Mar. 26, 1998

[51] Int. Cl.[7] ..... A46B 11/00

[52] U.S. Cl. ..... 15/207; 15/171; 15/189

[58] Field of Search ..... 15/207, 189, 190, 15/171, 174

[56] References Cited

U.S. PATENT DOCUMENTS

| | | | |
|---|---|---|---|
| 36,962 | 11/1862 | Miles, Jr. . | |
| 61,292 | 1/1867 | White . | |
| 397,076 | 1/1889 | Gladding . | |
| 581,109 | 4/1897 | Fairchild . | |
| 674,899 | 5/1901 | Bradt et al. | 15/189 |
| 742,839 | 11/1903 | Collins . | |
| 818,497 | 4/1906 | Whittemore . | |
| 1,101,520 | 6/1914 | Bemis . | |
| 1,153,118 | 9/1915 | Kimes . | |
| 1,371,601 | 3/1921 | Braun . | |
| 2,030,954 | 2/1936 | Zachry | 15/189 |
| 2,214,684 | 9/1940 | Stinnett . | |
| 2,864,113 | 12/1958 | Christie | 15/189 |
| 3,921,246 | 11/1975 | Pichelman . | |
| 4,120,115 | 10/1978 | Mushkin . | |
| 5,289,606 | 3/1994 | Ledinghamy . | |
| 5,379,579 | 1/1995 | Monahan, Jr. . | |
| 5,435,037 | 7/1995 | Ledingham . | |
| 5,590,437 | 1/1997 | McMillin . | |
| 5,678,276 | 10/1997 | Ledingham et al. . | |
| 5,836,037 | 11/1998 | Monahan | 15/189 |
| 5,865,509 | 2/1999 | Monahan | 300/21 |

FOREIGN PATENT DOCUMENTS

| | | |
|---|---|---|
| 28760 | 12/1911 | United Kingdom . |

*Primary Examiner*—Terrence R. Till
*Assistant Examiner*—Kaj K. Olsen
*Attorney, Agent, or Firm*—Richard B. O'Planick

[57] ABSTRACT

A broom hub is provided for use as a component in the manufacture of brooms which includes a wire retention mechanism. Generally, brooms include a handle, a plurality of bristles extending therefrom, and a wire wrapped around the bristles to secure the bristles to the handle. Specifically, the broom hub of this invention includes a sleeve for receiving the handle and a wire retention mechanism disposed on a sleeve. Preferably, the wire retention mechanism is configured to grasp the wire. Accordingly, the bristles are secured to the handle between the broom hub and the wire.

35 Claims, 6 Drawing Sheets

WIRE RETENTION MECHANISM FOR A BROOM

This invention relates to broom compontents utilized in the manufacture of brooms. More particularly, this invention relates to wire retention mechanisms for use with brooms having a handle and a plurality of bristles secured to the handle by a wire.

BACKGROUND OF THE INVENTION

Generally, brooms include a handle and a plurality of bristles extending from an end thereof. Specifically, brooms often include a hub disposed adjacent one end of the handle to which the bristles are attached. Commonly, the bristles are attached by placing the bristles around the hub and then wrapping a wire around the bristles thereby capturing the bristles between the wire and the hub. Devices of the above mentioned character are often formed by placing the handle in a spindle which rotates the handle. As the handle is spun, the wire is coiled around the bristles. Traditional handles are formed from wood or other similar material. To retain the wire in place and prevent uncoiling, an end portion of the wire is often looped around a nail which is driven into the handle.

Although the above described brooms perform adequately, it has been found that it would be desirable to utilize different materials for the handle. For instance, one may wish to utilize handles constructed of metal. For example, U.S. Pat. No. 5,590,437 to McMillen discloses a broom having an elongate tubular handle formed of metal and a plastic cover extending over the surface of the handle. The plastic cover includes a plurality of external ribs to provide gripping of the handle both during the winding operation or during use at a later time. In addition, McMillin teaches broom hubs which include a plug that is receivable within an end of the handle. The broom hub provides a hole to receive a leading edge of the wire. Finally, the wire is retained in place by a pin which is inserted into the metal handle.

Although the device to McMillin advances the art, brooms constructed in accordance with the teachings of McMillin have been found to have several drawbacks as well. First, such brooms require the pin to be driven into the handle. However, doing so may require additional cost due to having to provide the handle with an opening to receive the post. Secondly, such brooms require the user to spin the entire broom, including the handle, during the manufacturing process. However, it has been found that it would be desirable to provide broom hubs which can be spun without requiring the handle to be attached. Therefore, the handle may be secured to the broom at a later time if desirable. One skilled in the art can best appreciate that manufacturing brooms without the handle being attached would allow for more compact storage, for a less cumbersome manufacturing process, and for different implements to be alternately attached to a single handle. Finally, securing the wire to the pin may be time consuming. During the manufacturing process, the wire is fed into the leading hole and then wrapped a distance along the handle. Once the wire has been wrapped around the hub, the wrapping process is ceased by disengaging the machine utilized to spin the handle. Next, the operator must digitally grasp the wire and manually wrap the wire around the pin. One skilled in the art can best appreciate that performing this operation is time consuming.

To further advance the art, other devices have been proposed. Specifically, it is well known in the art to form broom hubs with an integrally formed post disposed on an outer surface thereof. The broom hub is fitted over the broom handle and secured thereto. Brooms formed in this manner have been found to advance the art. Since these devices allow for the wire to be secured by a pin disposed on the surface of the hub rather than with a pin that extends through the plug and handle, as in McMillin. As such, the broom hub may be more easily attached and removed from the handle.

Although such devices advance the art, these devices also have several drawbacks as well. First, using an integrally formed pin as the wire retention mechanism has proved to lack the structural integrity to operate effectively over an extended period of time. In particular, integrally formed pins have been found to fail if they impact an external surface or merely due to bending stresses realized due to tension in the wire. Secondly, such devices still require a substantial amount of manual labor to wrap the wire around the pin. One skilled in the art can appreciate that several advances could still be made in the art. Specifically, it would be desirable to have a wire retention mechanism that effectively retains the wire while reducing the opportunity that the wire retaining mechanism, such as the pin described above, fails with use. In addition to providing a device that performs effectively, it would also be desirable to provide a wire retention mechanism that reduces the amount of manual labor required to assemble the broom. Lastly, it would be desirable to assemble a broom in a manner that allows for the broom hub to be interchanged with other elements.

SUMMARY OF THE INVENTION

It is an object of this invention to provide a broom having a broom hub with a wire retention mechanism.

It is a further object of this invention that the retention mechanism is automatically actuated during assembly.

It is still a further object of this invention to provide a wire retention mechanism that is designed to reduce the likelihood of failure during use.

It is an additional object of this invention to provide the wire retention mechanism that grasps the wire.

It is still an additional object of this invention to provide the hub with a mechanism to releasably engage the handle.

In accordance with a preferred embodiment of this invention, these and other objects and advantages are accomplished as follows.

The present invention provides a broom hub which is uniquely configured for use in the assembly of brooms. Generally, brooms include a handle with a hub disposed at an end thereof and a plurality of bristles disposed around the hub. Commonly, the bristles are attached to the handle by a wire that is wrapped around the broom hub. Accordingly, the bristles are captured between the hub and the wire.

The broom hub of this invention is configured for use with brooms where the bristles are retained in place by a wire. The wire includes a leading end and an oppositely disposed terminal end. Specifically, the broom hub includes a sleeve portion which has an outer surface and an inwardly disposed inner surface. The handle is receivable within the sleeve portion of the hub. The hub further includes a wire securement member such that the leading end of the wire is secured to the hub. The broom hub of this invention further includes a wire retention mechanism. The wire retention mechanism is disposed on the outer surface of the sleeve and operates to grasp a terminal end of the wire such that the wire is retained in place.

During the manufacturing process, a plurality of bristles are placed around the hub. Once properly positioned, the leading end of the wire is secured to the broom hub by the wire securement member. Next, the hub is rotated so that the wire is coiled around the hub thus capturing the plurality of bristles between the outer surface of the sleeve and the wire. The rotation of the broom hub is continued until the wire is proximate the wire retention means. Finally, the wire retention mechanism is automatically actuated such that a terminal end of the wire is grasped by the wire retention mechanism.

One skilled in the art can best appreciate the above described broom hub provides several advantages. First, the broom hub of this invention includes a wire retention mechanism disposed on the broom hub. Therefore, the number of separate parts needed is substantially reduced. Secondly, since the wire retention means is disposed on the broom hub, and not on the handle, the handle may be attached to the hub after the bristles have been secured to the broom hub. Also, the broom hub may be removable from the handle at the option of the user of this invention. Advantageously, broom hubs formed in accordance with this invention may be shipped or even manufactured separately from the handles.

An additional advantage of the present invention is that the wire retention mechanism may be automatically actuated during the manufacturing process. Specifically, the wire retention mechanism is configured to grasp the terminal end of the wire once the wire is proximate the wire retention mechanism. During the manufacturing process, the operator does not have to expend additional effort to manually secure the terminal end of the wire to the broom hub.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE INVENTION

Figure 1:
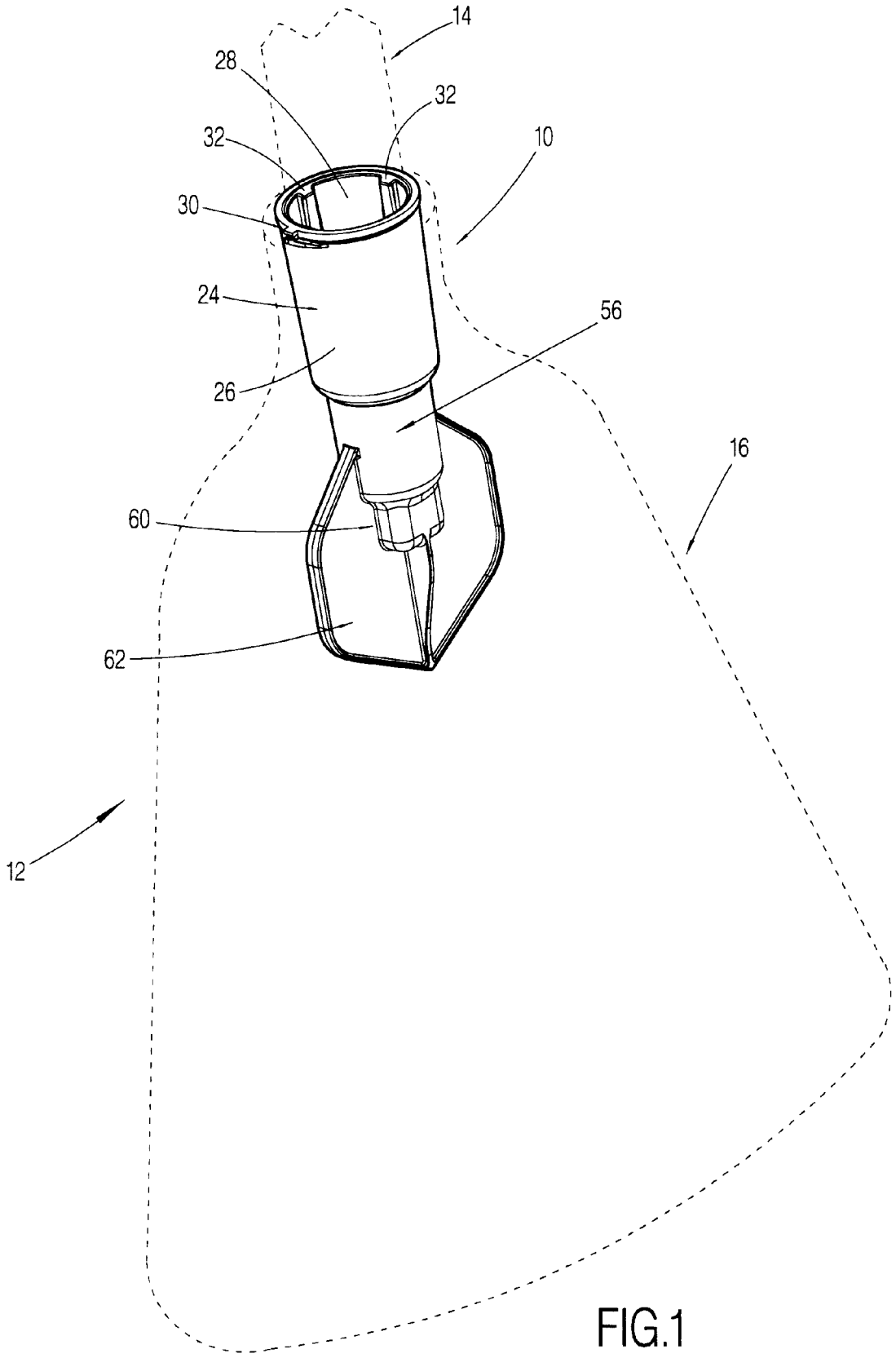
FIG. 1 shows a perspective view of a broom hub of this invention with a handle and bristles shown in phantom.

As best appreciated with reference to FIG. 1, a broom hub (10) is provided for use as a component in the manufacture of brooms (12) and other similar devices. Generally, a broom (12) includes a handle (14) having a first end, not shown, and a second end, not shown. The first end of the handle (14) is connected to the broom hub (10). The broom (12) also includes a plurality of bristles (16) disposed around the broom hub (10) and a wire, not shown, having a leading end and a terminal end. The wire is wrapped around the broom hub (10) thereby capturing the plurality of bristles (16) between the broom hub (10) and the wire. Preferably, the handle (14) is constructed of metal. However, various other materials may be utilized without deviating from the teaching of this invention. Commonly, the plurality of bristles (16) are formed from corn. Once again, various other materials may be utilized for the plurality of bristles (16) without departing from the teachings of this invention.

The broom hub (10) of this invention generally includes a sleeve portion (24) which provides an outer surface (26) and an inner surface (28) inwardly disposed relative to the outer surface. In addition, the broom hub (10) also includes a wire retention mechanism (30) disposed on the outer surface (26) of the sleeve portion (24). The wire retention mechanism (30) operates to grasp the terminal end of the wire.

In a preferred embodiment, the outer surface (26) and the inner surface (28) of the sleeve portion (24) are globally cylindrical in shape. Additionally, the inner surface (28) includes a plurality of ribs (32) such that at least a portion of the handle (14) is abutingly secured within the sleeve portion (24). The sleeve portion (24) includes an inward tapering portion (34) disposed adjacent the inner surface (28) and an outer lip (35) disposed in the outer surface (26) around the inward tapering portion (34).

Figure 2:
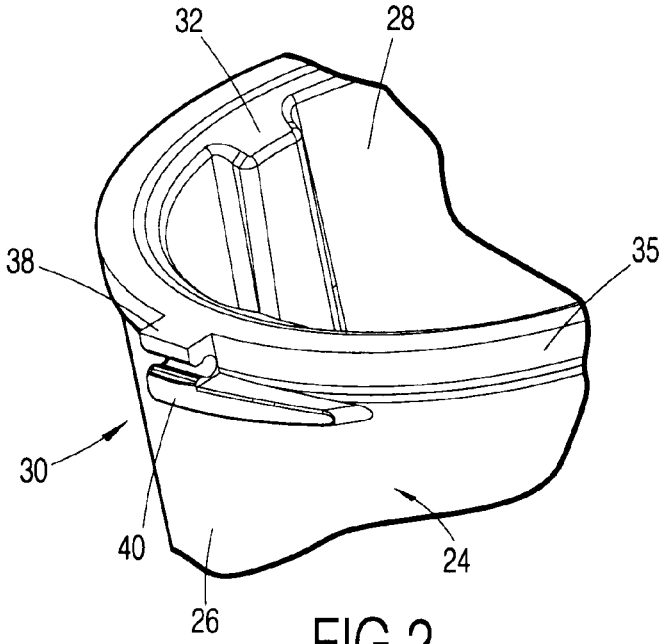
FIG. 2 shows a fragmentary perspective view of the broom hub viewed from above.
Figure 3:
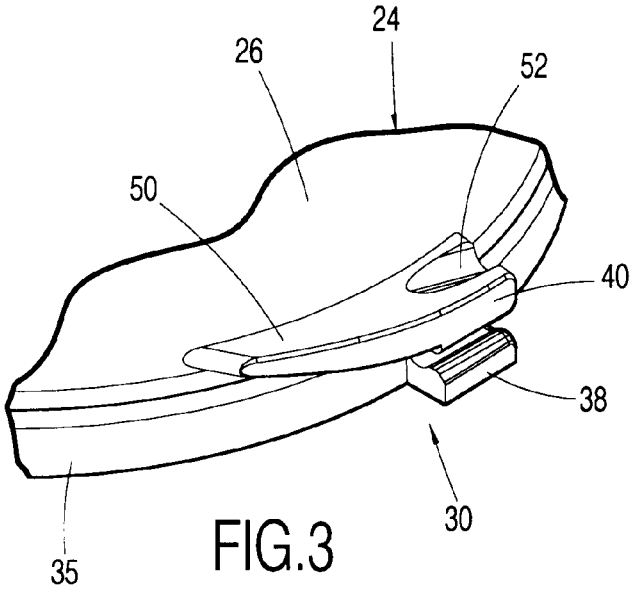
FIG. 3 shows a fragmentary perspective view of the broom hub viewed from below.
Figure 6:
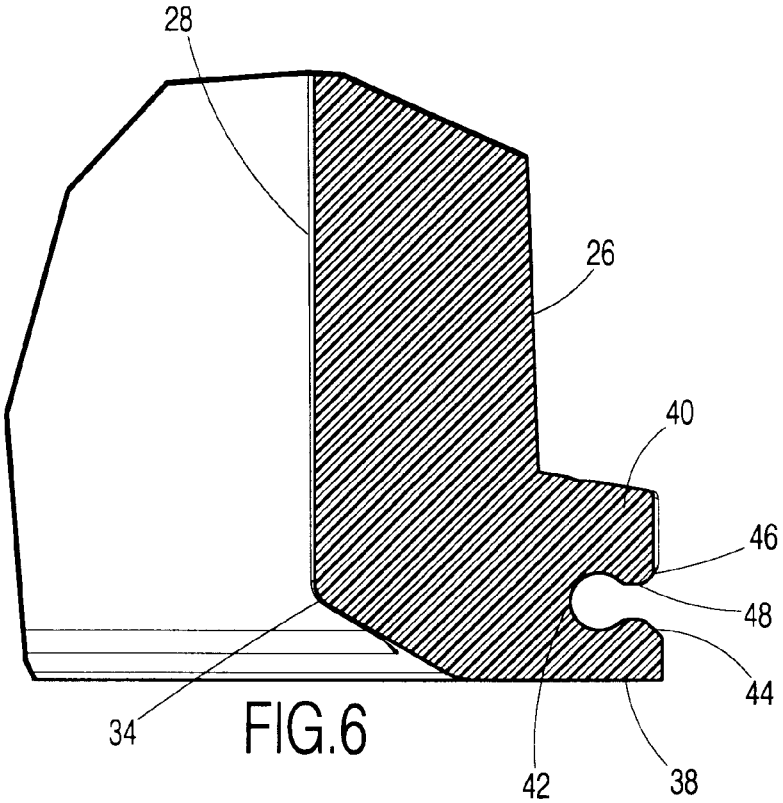
FIG. 6 shows a fragmentary cross-sectional view along line 6—6 of FIG. 4.

With particular reference to FIG. 2 and FIG. 3, the novel wire retention mechanism (30) of this invention includes an upper lock (38) disposed on the outer surface (26) of the sleeve portion (24) and a lower lock (40) disposed on the outer surface (26) of the sleeve portion (24) adjacent to the upper lock (38). It should be understood that the terms upper and lower are utilized merely for clarification purposes and should not be interpreted as limiting the scope of this invention. As best appreciated with reference to FIG. 6, the upper lock (38) and the lower lock (40) defines a channel (42) therebetween. The upper lock (38) includes a first angled portion (44). Similarly, the lower lock (40) includes a second angled portion (46). Accordingly, the first angled portion (44) and the second angled portion (46) taper inwardly to define a slot (48) having a width.

The wire retention mechanism (30) is uniquely configured to grasp the terminal end of the wire. Specifically, the channel (42) is sized and shaped to grasp the terminal end of the wire. Most preferably, the channel (42) is cylindrical in cross-section and has a size approximately equal to the diameter of the wire. In contrast, the width of the slot (48) is approximately less than the diameter of the wire. The wire retention mechanism (30) is preferably constructed from a material and in such a manner that the upper lock (38) and the lower lock (40) are elasticly deformable.

Figure 5:
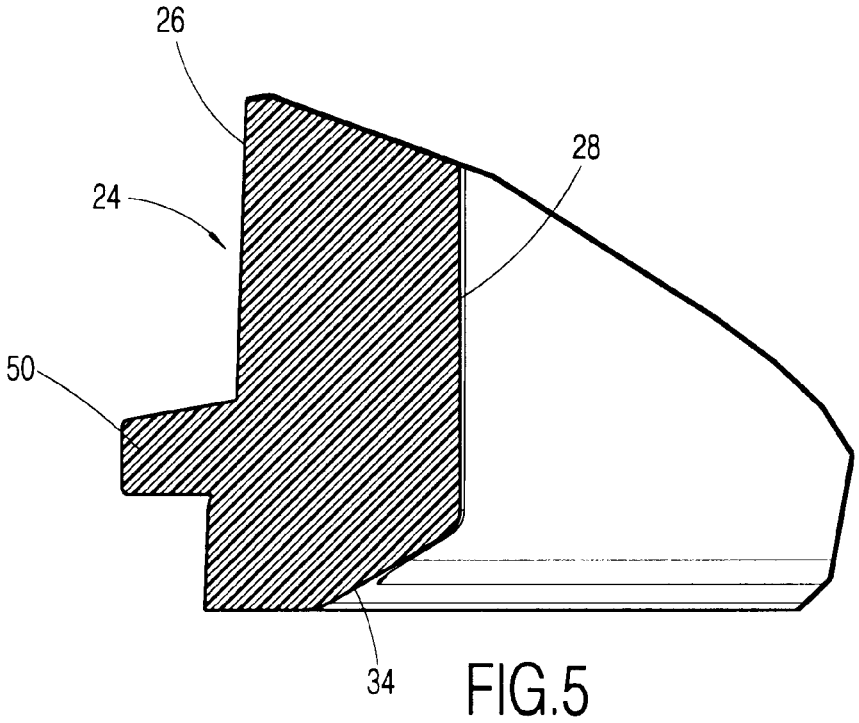
FIG. 5 shows a fragmentary cross-sectional view along line 5—5 of FIG. 4.

The broom hub (10) of this invention may include several other features that may be included in a preferred embodiment. As seen in FIG. 5, the outer surface (26) of the sleeve portion (24) includes a ramp portion (50) adjacent the lower lock (40). Specifically, the ramp portion (50) slopes towards the wire retention mechanism (30) so as to assist in directing the wire into the channel (42). Secondly, the outer surface (26) of the sleeve portion (24) includes a lower fulcrum, not shown, and an upper fulcrum, not shown. The lower fulcrum is disposed adjacent the lower lock (40) and oppositely disposed from the ramp portion (50). Similarly, the upper fulcrum is disposed adjacent the upper lock (38) and the lower fulcrum. Uniquely, once the wire is grasped by the wire retention mechanism (30), the wire may be alternately bent over the upper fulcrum and the lower fulcrum until the wire yields. Most prefereably, the upper fulcrum and lower fulcrum are integrally formed with the sleeve portion (24) and have a generally triangular shape. However, one skilled in the art can best appreciate that the fulcrums may have a variety of other geometric shapes without departing from the teachings of this invention. Lastly, the wire retention mechanism (30) preferably includes a groove (52), as shown in FIG. 3. The groove (52) operates to provide a region wherein the terminal end of the wire may be nested.

Figure 4:
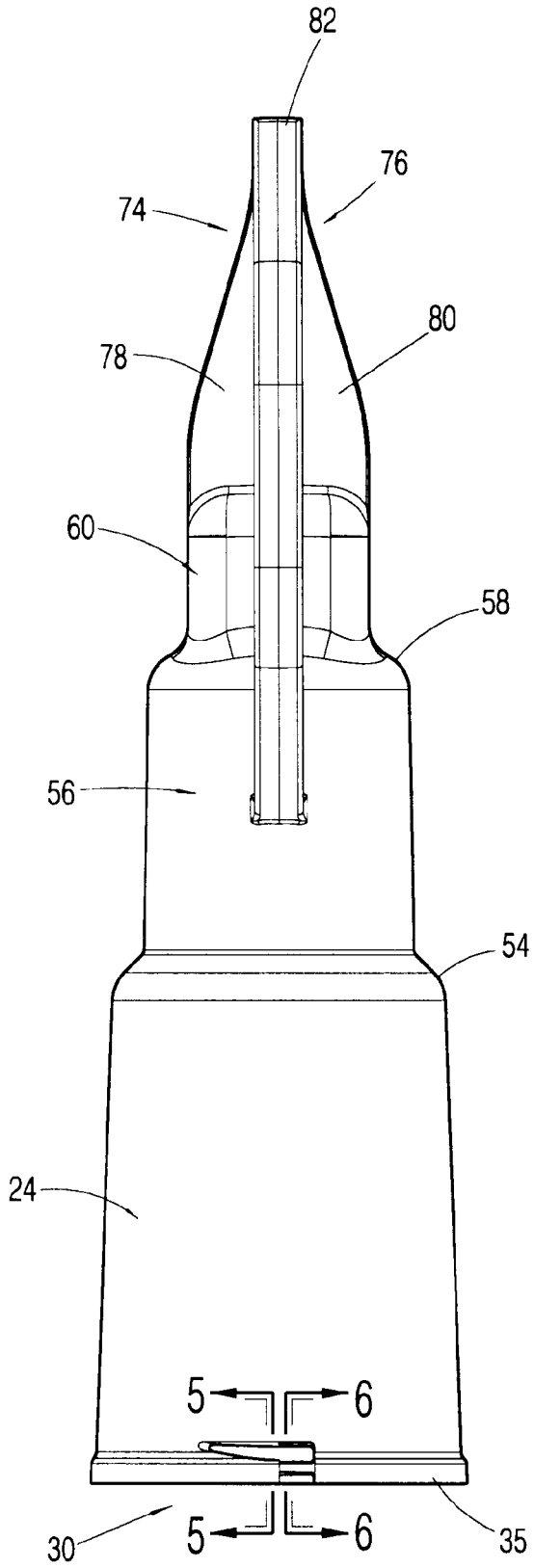
FIG. 4 shows a side elevational view of the broom hub of this invention.

As best appreciated with reference to FIG. 4, the broom hub (10) of this invention includes a first shoulder (54) disposed adjacent the sleeve portion (24). Adjacent the first shoulder (54) is a stem portion (56). In turn, the stem portion (56) terminates at a second shoulder (58). Next, the second shoulder (58) abuts a socket portion (60). Lastly, the broom hub (10) includes a fan portion (62) disposed around at least a portion of the socket portion (60).

Figure 8:
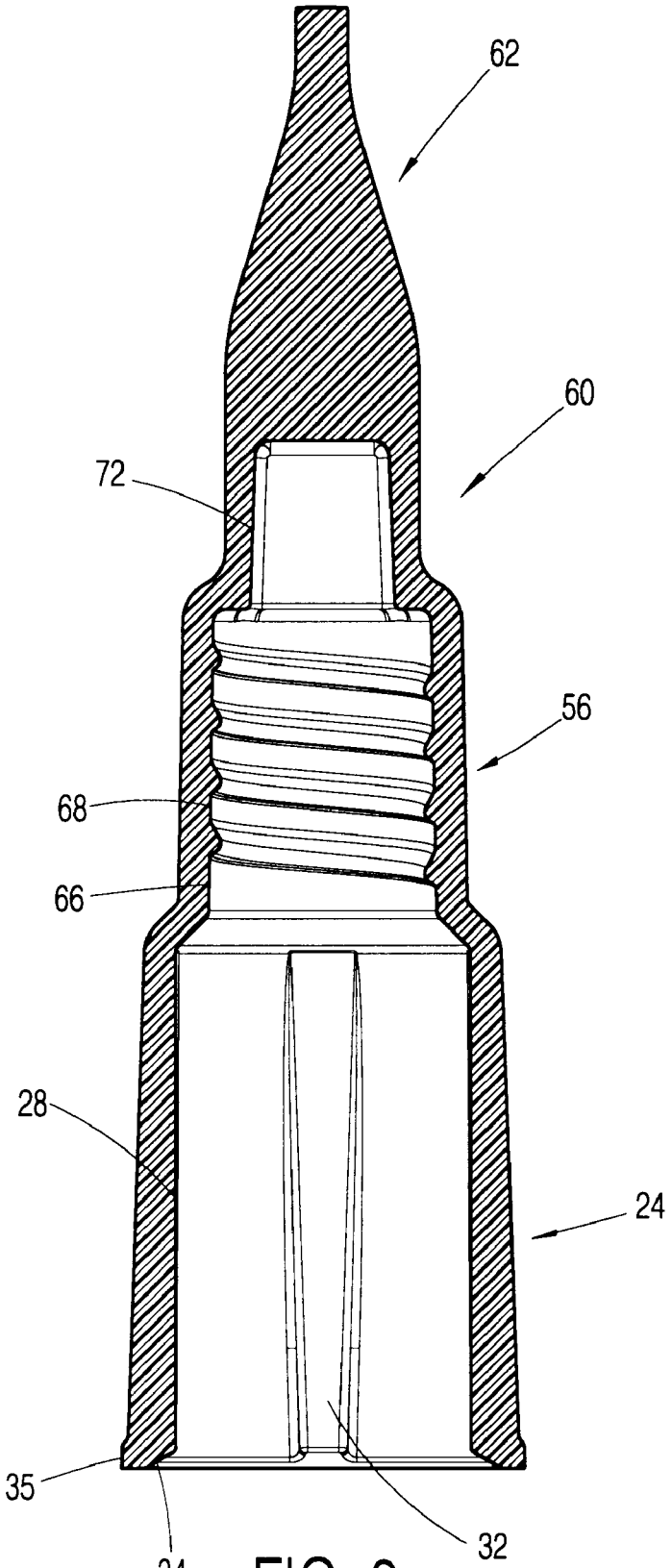
FIG. 8 shows a side cross-sectional view along line 8—8 of FIG. 7.

With particular reference to FIG. 4 and FIG. 8 viewed in conjunction, the stem portion (56) further includes an outer surface (64) and an inner surface (66). Preferably, the outer surface (64) and inner surface (66) of the stem portion are approximately cylindrical in cross-section. Most preferably, the inner surface (66) of the stem portion (58) has a threaded portion (68) coaxial with the sleeve portion (24).

The socket portion (60) includes an outer surface (70) and an inner surface (72) inwardly disposed relative to the outer surface (70). In a preferred embodiment, the inner surface (72) is approximately square in cross-section. However, one skilled in the art can best appreciate that various other geometric shapes could be employed as the socket without departing from the novel aspects of this invention. Furthermore, in a preferred embodiment, the outer surface (70) is approximately square in cross-section. However, one skilled in the art can best appreciate the precise shape of the outer surface (70) of the socket portion (60) is dependent upon the shape of the inner surface (72).

Figure 7:
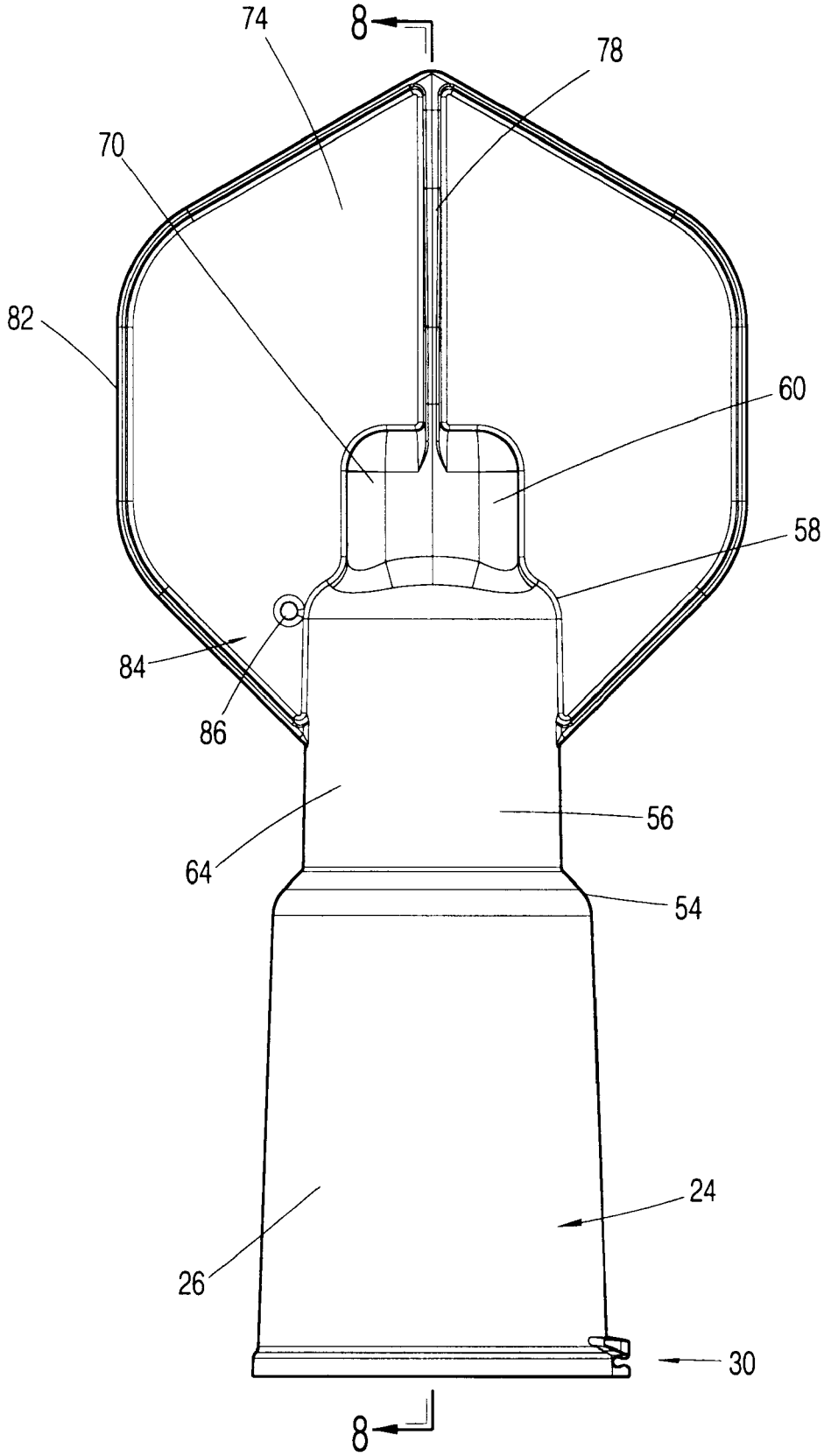
FIG. 7 shows a front elevational view of the hub of this invention.

Finally, the fan portion (62) includes a first face (74) and an oppositely disposed second face (76). The first face (74) includes a first vane (78) centrally disposed along the first face (74). Similarly, the second face (76) includes a second vane (80) centrally disposed along the second face (76). The first face (74) and the second face (76) are bounded by a peripherial edge (82) surrounding both the first face (74) and the second face (76). Together, the first vane (78), the second vane (80), and the peripherial edge (82) cooperate to provide the fan portion (62) with additional rigidity while also reducing material usage. As best appreciated with reference to FIG. 7, the fan portion (62) includes a securement member (84) for securing a leading end of the wire. The securement member (84) is preferably an aperture (86) through the fan portion (62). The aperture (86) is preferably disposed adjacent the sleeve portion (24). In a most preferred embodiment, the sleeve portion (24), the stem portion (56), the socket portion (60), the fan portion (62), and the wire retention mechanism (30) are integrally formed together. However, one skilled in the art can best appreciate that manufacturing any one or more of these elements separately would not depart from the teachings of this invention.

During the manufacturing process of the above disclosed invention, an operator inserts the broom hub (10) on to a spindle or other device designed to rotate. Next, a plurality of bristles (16) is attached around the broom hub (10). After the plurality of bristles (16) are appropriately disposed around the broom hub (10), a leading end of the wire is inserted into the aperture (86) on the fan portion (62). Next, the operator spins the broom hub (10) as the wire is fed onto the broom hub (10). Accordingly, the wire is coiled on to the broom hub (10) overlying the sleeve portion (24) such that the bristles (16) are captured between the sleeve portion (24) and the wire.

One novel aspect of this invention is that the wire is automatically retained by the wire retention mechanism (30) once the wire is proximate the wire retention mechanism (30). Specifically, once the wire is proximate the wire retention mechanism (30), the wire is led between the first angled portion (44) and the second angled portion (46) by the ramp portion (50). As the broom hub (10) continues to rotate, the wire begins to exert a downward force on the angled portions (44, 46) such that the upper lock (38) and the lower lock (40) are flexed away from one another. Alternatively or in combination with the above, the operator may push the wire toward the broom hub (10) thereby assisting in forcing the lower lock (40) and the upper lock (38) to flex outwardly. Flexing the upper lock (38) and the lower lock (40) results in the width of the slot (48) to be increased. Ultimately, the width of the slot (48) is increased until the wire is capable of passing through the slot (48). Once through the slot (48), the lower lock (40) and the upper lock (38) flex back towards one another. As such, the wire is retained within the channel (42) between the lower lock (40) and the upper lock (38). Finally, the operator may separate the wire, which is coiled around the broom hub (10), from the remainder of the wire repeatedly yielding the wire until it snaps free. To assist in this operation, the broom hub (10) of this invention is preferably fitted with the lower fulcrum and the upper fulcrum to assist the operator. Specifically, the operator may alternately bend the wire around the lower fulcrum and the upper fulcrum until the wire yields.

In accordance with the teachings of this invention, the wire retention mechanism (30) operates to grasp the wire. One skilled in the art can best appreciate that the amount that the wire retention mechanism (30) grasps the wire is dependent upon a variety of factors. In particular, the grasping force may be increased by varying one or more of the following: decreasing the diameter of the channel (42), increasing the diameter of the wire, or constructing the wire retention mechanism (30) from a material or in a manner that increases the resistance of the wire retention mechanism from deformation.

After the initial manufacturing process, as outlined above is completed, the broom hub (10) may be removed from the spindle. At this point, the handle (14) may be attached to the broom hub (10) by the operator. Alternately, the broom hub (10) may be attached at a later time by the user of this invention. Specifically, the handle (14) is attached by screwing the handle (14) into the broom hub (10). Preferably, the handle (14) has an end that includes threading which corresponds to the threaded portion (68) within the stem portion (56).

One skilled in the art can best appreciate that the above disclosed invention provides several advantages. First, the above disclose invention provides a novel wire retention mechanism (30) that is attached to the broom hub (10). As disclosed in a preferred embodiment, the wire retention mechanism (30) is integrally formed with the broom hub (10). Accordingly, the present invention reduces the use of separate parts which would increase manufacturing costs.

Another advantage found in the present invention is that the wire retention mechanism (30) is automatically actuated during the wrapping operation. Once the wire is proximate the wire retention mechanism (30), the wire is automatically retained with minimal effort. Accordingly, the cost associated with having to manually attach the wire to the broom hub (10) has been substantially reduced.

Yet, another advantage found in the present invention is that the wire retention mechanism (30) is uniquely designed to reduce the likelihood that the wire retention mechanism (30) will fail during use. Specifically, this advantage is achieved by the novel wire retention mechanism (30) which operates by grasping the wire.

Still an additional advantage of this invention is that the above advantages are achieved while also providing a broom hub (10) that releasably engages the handle (14). This advantage is achieved through use of the threaded portion (68) which engaged the handle (14). Accordingly, the plurality of bristles (16) may be attached to the broom hub (10) without the handle (14) being concurrently attached. As such, the handle (14) is capable of being manufactured and even shipped separately from the broom hub (10) of this invention. Additionally, the user of this invention may remove the broom hub (10) from handle (14) when doing so is deemed desirable by the user.

While this invention has been described in terms of a preferred embodiment, it is apparent that other forms could be adopted by one skilled in the art, for example by modifying the appearance or structure of the broom core, or by substituting appropriate materials. Accordingly, the scope of this invention is to be limited only by the following claims.

What is claimed is:

1. A broom hub for use with a wire, said wire having a leading end and an oppositely disposed terminal end, said wire further having a diameter, said hub comprising:

a sleeve portion having an outer surface and an inwardly disposed inner surface;

a retention channel for grasping said terminal end of said wire, said retention channel being disposed on said sleeve portion and having a dimension approximately equal the diameter of said wire;

a slot communicating with said retention channel and having a width approximately less than the diameter of said wire.

2. A broom hub as recited in claim 1 wherein said retention channel is defined by an upper lock member disposed on said outer surface of said sleeve; and a lower lock member disposed on said outer surface adjacent said upper lock such that said upper lock and said lower lock define said channel disposed between said upper lock and said lower lock.

3. A broom hub for use with a wire, said wire having a leading end and an oppositely disposed terminal end, said wire further having a diameter, said hub comprising:

a sleeve position having an outer surface and an inwardly disposed inner surface;

retention means for grasping said terminal end of said wire, said retention means being disposed on said sleeve portion; and securement means for securing said leading end of said wire, said securement means being adjacent said sleeve;

said retention means comprising: an upper lock member disposed on said outer surface of said sleeve; and a lower lock member disposed on said outer surface adjacent said upper lock such that said upper lock and said lower lock define a channel disposed between said upper lock and said lower lock;

wherein said upper lock comprises a first angled portion, and wherein said lower lock comprises a second angled portion such that said first angled portion and said second angled portion define a slot between said first angled portion and said second angled portion.

4. A broom hub as recited in claim 3 wherein said channel is approximately equal the diameter of said wire.

5. A broom hub as recited in claim 4 wherein said width of said slot is approximately less than the diameter of said wire.

6. A broom hub as recited in claim 5 wherein said retention means is constructed of a material that is elasticly deformable such that said wire may be urged past said slot into said channel and grasped between said upper lock and said lower lock.

7. A broom hub as recited in claim 6 wherein said broom hub further includes a ramp portion disposed on said sleeve portion adjacent said lower lock.

8. A broom hub as recited in claim 7 wherein said broom hub further includes a groove disposed on said lower lock such that said terminal end of said wire may be nested therein.

9. A broom hub as recited in claim 8 wherein said broom hub further includes a lower fulcrum adjacent said lower lock and an upper fulcrum adjacent said upper lock.

10. A broom hub as recited in claim 9 wherein said hub further comprises:

a stem portion disposed proximate said sleeve portion;

a socket portion disposed proximate said stem portion; and a fan portion disposed around at least a portion of said socket portion.

11. A broom hub as recited in claim 10 wherein said sleeve portion further comprises:

an inward tapering portion disposed proximate said inner surface;

an outer lip disposed on said outer surface around said inward tapering portion; and a plurality of ribs disposed on said inner surface.

12. A broom hub as recited in claim 10 wherein said stem portion comprises:

an inner surface, said inner surface having a threaded portion disposed along at least a portion of said inner surface; and an outer surface outwardly disposed relative to said inner surface.

13. A broom hub as recited in claim 10 wherein said socket portion comprises:

an inner surface, said inner surface having an approximately rectangular shape; and an outer surface outwardly disposed relative to said inner surface.

14. A broom hub as recited in claim 10 wherein said fan portion comprises:

a first face having a first vane extending from said first face; and a second face oppositely disposed relative to said first face, said second face having a second vane extending from said second face.

15. A broom hub as recited in claim 14 wherein said fan portion has an aperture through said first face and said second face sized to receive said leading end of said wire.

16. A broom hub as recited in claim 10 wherein said hub further comprises:

a first shoulder disposed between said sleeve portion and said stem portion; and a second shoulder disposed between said stem portion and said socket portion.

17. A broom hub for use with a wire, said wire having a leading end and a oppositely disposed terminal end, said wire further having a diameter, said broom hub comprising:

a sleeve portion having an outer surface and an inner surface inwardly disposed relative to said outer surface, said inner surface being approximately cylindrical, said sleeve portion further including a plurality of ribs disposed on said inner surface a first shoulder proximate said sleeve portion;

a stem portion disposed proximate said first shoulder, said stem portion including an outer surface, said outer surface being approximately cylindrical, said stem portion further including an inner surface, said inner surface having a threaded portion;

a second shoulder proximate said stem portion;

a socket portion disposed proximate said second shoulder, said socket providing an inner socket, said inner socket being rectangular in cross-section;

a fan portion disposed around said socket portion, said fan portion having a first face and a second face oppositely disposed from said first face, said fan portion having a peripherial edge surrounding said fan, said first face including a first vane portion, said second face including a second vane portion;

a wire retention means disposed on said sleeve, said wire retention means including an upper lock and a lower lock, said upper lock and said lower lock defining a channel therebetween, said upper lock including a first angled portion and said lower lock including a second angled portion, said first angled portion and said second angled portion defining a slot having a width therebetween, said slot being disposed between said upper lock and said lower lock, said channel being approximately equal to the diameter of the wire, said width of said slot being approximately less than the diameter of the wire; and a ramp portion disposed adjacent to said wire retention means.

18. A broom comprising:

a broom hub comprising a sleeve portion having an outer surface and an inwardly disposed inner surface, a retention channel for grasping said terminal end of a wire, said retention channel being disposed on said sleeve portion and having a dimension approximately equal the diameter of said wire; and a slot communicating with said retention channel and having a width approximately less than the diameter of said wire.

19. A broom as recited in claim 18, wherein said retention channel is defined by an upper lock member disposed on said outer surface of said sleeve; and a lower lock member disposed on said outer surface adjacent said upper lock such that said upper lock and said lower lock define said channel disposed between said upper lock and said lower lock.

20. A broom comprising:

a broom hub comprising a sleeve portion having an outer surface and an inwardly disposed inner surface, retention means for grasping said terminal end of said wire, said retention means being disposed on said sleeve portion, and securement means for securing said leading end of said wire, said securement means being adjacent said sleeve;

said retention means comprises:

an upper lock member disposed on said outer surface of said sleeve; and a lower lock member disposed on said outer surface adjacent said upper lock such that said upper lock and said lower lock define a channel disposed between said upper lock and said lower lock;

wherein said upper lock comprises a first angled portion, and wherein said lower lock comprises a second angled portion such that said first angled portion and said second angled portion define a slot between said first angled portion and said second angled portion.

21. A broom as recited in claim 20 wherein said channel is approximately equal the diameter of said wire.

22. A broom as recited in claim 21 wherein said width of said slot is approximately less than the diameter of said wire.

23. A broom as recited in claim 22 wherein said retention means is constructed of a material that is elasticly deformable such that said wire may be urged past said slot into said channel and grasped between said upper lock and said lower lock.

24. A broom as recited in claim 23 wherein said broom hub further includes a ramp portion disposed on said sleeve portion adjacent said lower lock.

25. A broom as recited in claim 24 wherein said broom hub further includes a groove disposed on said lower lock such that said terminal end of said wire may be nested therein.

26. A broom as recited in claim 25 wherein said broom hub further includes a lower fulcrum adjacent said lower lock and an upper fulcrum adjacent said upper lock.

27. A broom as recited in claim 26 wherein said hub further comprises:

a stem portion disposed proximate said sleeve portion;

a socket portion disposed proximate said stem portion; and a fan portion disposed around at least a portion of said socket portion.

28. A broom as recited in claim 27 wherein said sleeve portion further comprises:

an inward tapering portion disposed proximate said inner surface;

an outer lip disposed on said outer surface around said inward tapering portion; and a plurality of ribs disposed on said inner surface.

29. A broom as recited in claim 27 wherein said stem portion comprises:

an inner surface, said inner surface having a threaded portion disposed along at least a portion of said inner surface; and an outer surface outwardly disposed relative to said inner surface.

30. A broom as recited in claim 27 wherein said socket portion comprises:

an inner surface, said inner surface having an approximately rectangular shape; and an outer surface outwardly disposed relative to said inner surface.

31. A broom as recited in claim 27 wherein said fan portion comprises:

a first face having a first vane extending from said first face; and a second face oppositely disposed relative to said first face, said second face having a second vane extending from said second face.

32. A broom as recited in claim 31 wherein said fan portion has an aperture through said first face and said second face sized to receive said leading end of said wire.

33. A broom as recited in claim 27 wherein said broom hub further comprises:

a first shoulder disposed between said sleeve portion and said stem portion; and a second shoulder disposed between said stem portion and said socket portion.

34. A broom as recited in claim 33 wherein said broom further comprising:

a handle, said handle including a first end and a second end oppositely disposed from said first end, said first end including a threaded portion;

a plurality of bristles disposed around said hub; and a wire disposed around said plurality of bristles, said wire having a leading end and an oppositely disposed terminal, said wire further having a diameter, said leading end of said wire being secured by said securement means, said terminal end of said wire being retained within said channel by said wire retention means such that said bristles are secured to said hub between said wire and said broom hub.

35. A broom comprising:

a handle, said handle including a first end and a second end oppositely disposed from said first end, said first end including a threaded portion;

a broom hub comprising a sleeve portion having an outer surface and an inner surface inwardly disposed relative to said outer surface, said inner surface being approximately cylindrical, said sleeve portion further including a plurality of ribs disposed on said inner surface, a first shoulder proximate said sleeve portion, a stem portion disposed proximate said first shoulder, said stem portion including an outer surface, said outer surface being approximately cylindrical, said stem portion further including an inner surface, said inner surface having a threaded portion, a second shoulder proximate said stem portion, a socket portion disposed proximate said second shoulder, said socket providing an inner socket, said inner socket being rectangular in cross-section, a fan portion disposed around said socket portion, said fan portion having a first face and a second face oppositely disposed from said first face, said fan portion having a peripherial edge surrounding said fan, said first face including a first vane portion, said second face including a second vane portion, a wire retention means disposed on said sleeve, said wire retention mechanism including an upper lock and a lower lock, said upper lock and said lower lock defining a channel therebetween, said upper lock including a first angled portion and said lower lock including a second angled portion, said first angled portion and said second angled portion defining a slot therebetween, said slot being disposed between said upper lock and said lower lock, a ramp portion disposed adjacent to said wire retention mechanism; and a plurality of bristles disposed around said hub; and a wire disposed around said plurality of bristles, said wire having a leading end and an oppositely disposed terminal, said wire further having a diameter, said leading end of said wire being secured by said securement means, said terminal end of said wire being retained within said channel by said wire retention means such that said bristles are secured to said hub between said wire and said broom hub.

* * * * *